United States Patent [19]

Kirkland

[11] Patent Number: 4,970,701

[45] Date of Patent: Nov. 13, 1990

[54] WIRE DETECTOR

[75] Inventor: James L. Kirkland, Panama City, Fla.

[73] Assignee: The United States of America as represented by the Secretary of the Navy, Washington, D.C.

[21] Appl. No.: 126,938

[22] Filed: Mar. 22, 1971

[51] Int. Cl.[5] ..... F42B 22/42

[52] U.S. Cl. ..... 367/131; 102/402; 324/67

[58] Field of Search ..... 340/4 R; 324/3, 66, 324/67; 367/131; 102/402

[56] References Cited

U.S. PATENT DOCUMENTS 1,812,392 6/1931 Zuschlag ..... 324/67 X 3,617,865 11/1971 Hakata ..... 324/326

*Primary Examiner*—Nelson Moskowitz

*Assistant Examiner*—Daniel T. Pihulic

*Attorney, Agent, or Firm*—Sol Sheinbein; John Becker; Harvey David

[57] ABSTRACT

Disclosed is a system for locating a wire that is partially submerged within water and partially extends out thereof which includes a transmitter for broadcasting radio frequency electromagnetic signals, a phase gradiometer for receiving said radio frequency electromagnetic signals after they have been received by that portion of said wire that extends out of said water and re-radiated by that portion of said wire that is submerged therein and for timely producing a pair of output signals in response thereto, a pair of constant output amplifiers for processing said pair of gradiometer output signals to identical useful levels, a phase comparator for determining the phase relationship between said pair of processed output signals, and a readout for indicating said phase relationship. The aforesaid phase gradiometer may be housed in a probe-type of mobile underwater vehicle which is towed by a tractor vehicle in such manner as to cause said phase gradiometer to traverse an underwater course in search of said wire.

15 Claims, 1 Drawing Sheet

WIRE DETECTOR

STATEMENT OF GOVERNMENT INTEREST

The invention described herein may be manufactured and used by or for the Government of the United States of America for governmental purposes without the payment of any royalties thereon or therefor.

FIELD OF THE INVENTION

The present invention relates in general to object locators and in particular is a method and means for locating wires, pipes, cables, conduits, and the like, of an electrically conductive nature which are partially submerged in water and partially extend out of said water. In even greater particularity, it is a method and means for detecting electrical control wires of the type that provide detonation of marine mines from a firing box that is located at some remote land position.

DESCRIPTION OF THE PRIOR ART

Heretofore, numerous prior art devices have been employed to detect marine mine control wires and other electrically conductive submarine paraphernalia that partially extends out of the waters of rivers, lakes, estuaries, bays, oceans, and the like. And for some purposes, said prior art devices have been quite satisfactory. For example, towed grapnels have been used to snag such wires, cutters have been employed by covert swimmers to sever and thus disable such wires, heavy chains have been used to break or drag such wires, and various and sundry combinations thereof have been employed for similar purposes. Unfortunately, under some circumstances, the aforesaid prior art devices and systems leave a great deal to be desired because no positive indication is obtained therefrom that one or more of such electrical wires have been encountered, and, thus, it may be seen that to a considerable extent the actual results obtained are left up to chance. Moreover, inasmuch as conditions of the water and the circumstances under which it is being traveled, especially during wartime, often prevents any effective inspection of the bottoms of wires, bays, estuaries, lakes, oceans, and the like, for mines and cut or uncut mine control wires. As a result of this, people navigating and working in mined waters perform their tasks under extremely hazardous conditions, usually on little or more than hope or faith that the aforementioned prior art devices and procedures have been effective in neutralizing the mines to which they are being exposed.

Where the safety of military personnel and equipment is concerned, it may readily be seen that effecting a far more positive determination that a marine mine control wire has been located and disabled or destroyed — and thereby disabling marine mines by having its detonation power supply removed therefrom — is of paramount importance. Of course, this is especially true regarding marine mines in muddy rivers which, perhaps, must be navigated in enemy territory by ships, barges, boats, etc., in order to transport much needed supplies and people to inland battle areas or other strategic locations.

Another prior art system which has been found to be satisfactory for many practical purposes is that disclosed in patent application Ser. No. 632,145, entitled "Brackish-Water Wire Detector," filed in the U.S. Patent Office on April 10, 1967, by Ernest A. Hogge. In that system, detection of wires that are partially submerged within water and partially extending out thereof is accomplished by broadcasting electromagnetic energy to the underwater portion of said wire by means of an underwater transmitter means and receiving and homing on that portion of said electromagnetic energy which is radiated in the atmosphere by the portion of the wire that is not submerged within the water.

Although this prior art system, as previously mentioned, is quite satisfactory for many purposes, it is not as covert as desired during military engagements. Furthermore, rather elaborate equipment is involved because radio frequency electromagnetic energy must be broadcast by those searching for mine control wires.

SUMMARY OF THE INVENTION

The present invention overcomes some of the disadvantages of all of the known prior art systems. It is a vast improvement over those involving probability of wire detection, while it is a considerable improvement over the last mentioned prior art system during some operational circumstances. Hence, for its intended purposes, it is exceedingly useful and beneficial.

Very simply, the subject invention constitutes a unique method and means for detecting partially water-submerged wires because it incorporates a phase gradiometer having a pair of spatially disposed radio receivers which are towed along the bottom of the water where marine mine control wires are suspected of being located. Because such wires are partially located both in and out of said water, the atmospheric portion acts as an antenna and receives the radio frequency energy broadcast by commercial or other radio broadcast stations within the vicinity thereof. Said radio frequency energy travels along said wire as electrical current and, thus, is re-radiated to some extent by the entire underwater portion thereof. As the aforesaid radio receivers are towed along the bottom of the water, each thereof picks up the radio frequency energy emanating from the underwater portion of the wire as it is approached thereby; however, because of their relative spacing, the respective receptions thereof (and, hence, the outputs thereof) occur at slightly different times, thereby being phase related. By means of a phase comparator and readout, said phase relationship is determined; and by means of calibration, said determined phase relationship may be converted to an indication of the presence and location of an underwater mine control wire, so that whatever action is deemed necessary with respect to it may be immediately taken.

Although the foregoing discussion of the subject invention indicates that it is exceedingly important for finding wires and the like within water, it should be understood that it is also operable for finding such objects in other environmental mediums, as well. Hence, for instance, when properly designed therefor, it may be used to find wires, etc., in or on land, in or on other solid mediums, in chemical powder, in air, in space, in oil, or in other fluids. Obviously, it would be well within the purview of one skilled in the art having the benefit of the teachings herewith presented to make whatever design choices are necessary to put the subject invention into condition to be used as warranted by operational circumstances. But to keep this disclosure as simple as possible, without intending to limit the invention thereto, it will be discussed as if it were being employed to locate marine mine control wires that extend both in and out of an aqueous medium, such as river water.

It is, therefore, an object of this invention to provide an improved wire detector system.

Another object of this invention is to provide an improved electrically conductive object locator.

A further object of this invention is to provide an improved marine mine control wire locator.

A further object of this invention is to provide a wire detector that does not touch or harm the wire and that permits the detection thereof in a passive, covert manner.

Still another object of this invention is to provide a unique wire detector system that may optionally use the transmitted radio frequency electromagnetic signals of either a commercial radio station or a custom built radio station as the operative signals therein.

Another object of this invention is to provide an improved method and means for determining whether or not detected river mine lead wires extending upon the river bank have been cut, thereby, in turn, determining whether or not said mine has been effectively disconnected from its firing box.

Another object of this invention is to provide an improved method and means for ascertaining whether or not rivers, canals, lakes, bays, channels, oceans, or any other locations would be safe for transports traveling thereon, as far as submarine mine and/or military attack is concerned.

Another object of this invention is to provide a method and means for facilitating the neutralizing of river and other marine mines.

Another object of this invention is to provide an improved method and means for facilitating the sweeping of marine mine fields, the mines of which are of the type detonated electrically through insulated command wires extending to a manually or other firing device located out of the water.

A further object of this invention is to provide a method and means for improving the signal-to-noise ratio of an electromagnetically operated electrical conductor detector.

Still another object of this invention is to provide an improved, passive, covert method and means for inferentially determining the possible location from which a clandestine enemy attack or ambush could originate along a river bank or other water-land interface.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
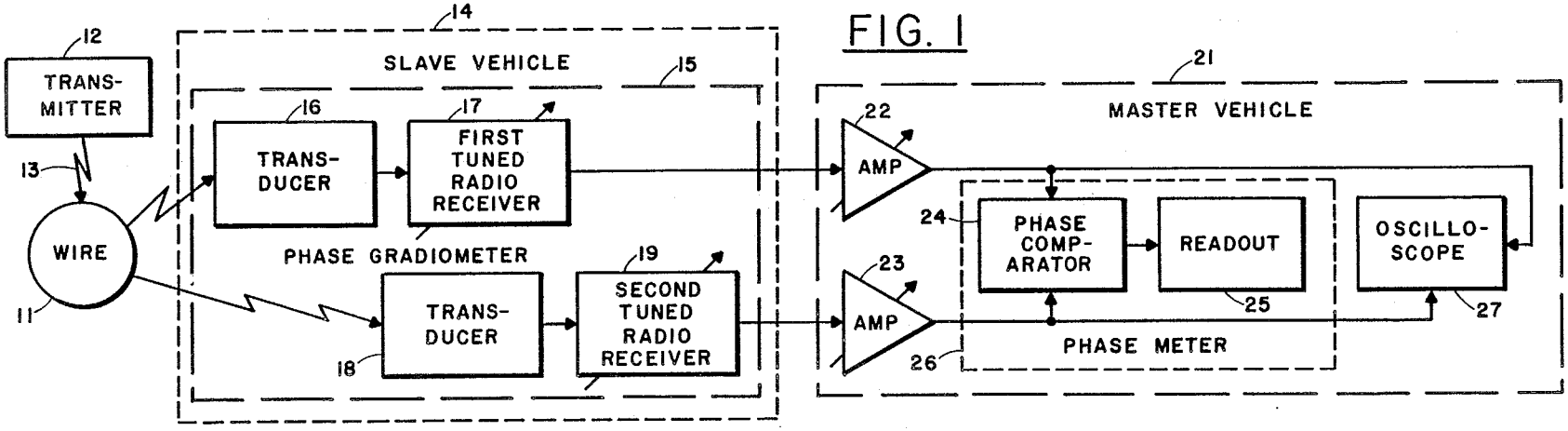
FIG. 1 is a block diagram of the system constituting the subject invention.

Referring now to FIG. 1, there is shown a wire 11 which is to be located and is disposed in such manner that a portion thereof is submerged in water and a portion thereof is disposed in the atmosphere. Of course, although element 11 is herewith disclosed simply as a wire, it may be one or more of any kind of wires, either insulated or uninsulated, or even have a coaxial cable form. Moreover, as a matter of fact, it may also be any electrically conductive object which has a geometrical configuration such that a portion thereof may be submerged in water and a portion thereof extends out of said water.

A radio frequency transmitter 12 for broadcasting electromagnetic energy 13 is located at any suitable place where the radio waves therefrom will be picked up by that portion of the aforesaid wire that is not submerged in water. It may, for example, be a commercial radio station, or it could be one that is constructed for the purpose of being a component part of the subject system. It could be located at some stationary place on land; it could be located on board a ship; it could be located in any suitable aircraft; it could be located at any suitable place where the radio frequency emanations 13 therefrom travel to that portion of the aforesaid wire 11 that is above the water. From the foregoing, it may obviously be seen that it may be disposed in either an immobile or mobile position.

A predetermined probe-like slave vehicle 14—such as, for example, a pushed or pulled or otherwise guided and propelled underwater vehicle—contains a phase gradiometer 15 which is adapted for being responsive to radio frequency electromagnetic energy of the type that is broadcast by the aforementioned transmitter 12. Included therein is a first receiving transducer 16, the output of which is connected to the input of a first tuned radio receiver 17, the response frequency of which is preferably adjustable, so as to accommodate it to a variety of environmental circumstances and operational procedures. A second receiving transducer 18 is spatially disposed from said receiving transducer 16 a predetermined distance, as required by environmental and operational circumstances. A second tuned radio receiver is connected to the output thereof.

Obviously, transducers 16 and 18 may incorporate any desired designs as will make them function for any given purpose. Hence, for instance (but not by way of limitation), they could be dipole antennas, inductance coils, whip antennas, portions of the skin of slave vehicle 14, or any other electrical and/or mechanical configuration, just so long as they will be responsive to the radio waves broadcast by transmitter 12.

In this particular preferred embodiment of the system constituting the subject invention, the aforesaid slave vehicle 14 is connected to a master vehicle 21 of the tractor type which may be used to push or pull slave vehicle 14 and the phase gradiometer contained therein through the water being searched for wires. However, if so desired, slave vehicle 14 may be a self-contained, self-propelled probe which is guided by any appropriate telemetering system, such as, for example, a sonar system, or the like. Also, it should be obvious that master vehicle 21 may be of any type warranted by the operational circumstances; hence, it may be a boat, a helicopter, an airplane, a submarine vehicle, or the like.

The outputs of radio receivers 17 and 19 constitute the outputs of phase gradiometer 15, and they are respectively connected to the inputs of a pair of constant output amplifiers (limiters) 22 and 23. Although the outputs of said amplifiers 22 and 23 are constant, they are adjustable so the constant levels thereof may be made substantially equal or set as some other desired level. The outputs of constant level amplifiers 22 and 23 are connected to the inputs of a phase comparator 24, which is preferably adjustable so that a human or other operator may adjust it to provide a zero or null output by shifting the relative phases of the signals supplied thereto by amplifiers 22 and 23. Although any suitable comparator may be used as comparator 24, the balanced modulator type or the phase meter based on trigger (flip-flop) circuitry actuated by pulse trains disclosed at pages 272 and 273 of the book entitled ELECTRONIC MEASUREMENTS, by Frederick E. Terman, McGraw-Hill Book Company, Copyright 1935, may be employed for such purpose, if so desired. The output of phase comparator 24 is connected to the input of any suitable type of readout 25, whereby the combination becomes a phasemeter 26.

The outputs of amplifiers 22 and 23 are optionally connected to the horizontal and vertical plates of an oscilloscope 27, and in such case, oscilloscope 27 is likewise operative as a phase comparator, as well as a visual readout, thereby, in effect, making it a self-contained phasemeter, too. In such case, the readout thereof is in the form of a lissajous pattern which, of course, may be calibrated to convey information of meaning to a trained operator.

At this time, it should perhaps be understood that all of the block-defined elements of the system of FIG. 1 are conventional and well known, per se; hence, it is their interconnections and interactions which combine to become the subject invention and produce the aforementioned improved detection results.

Figure 2:
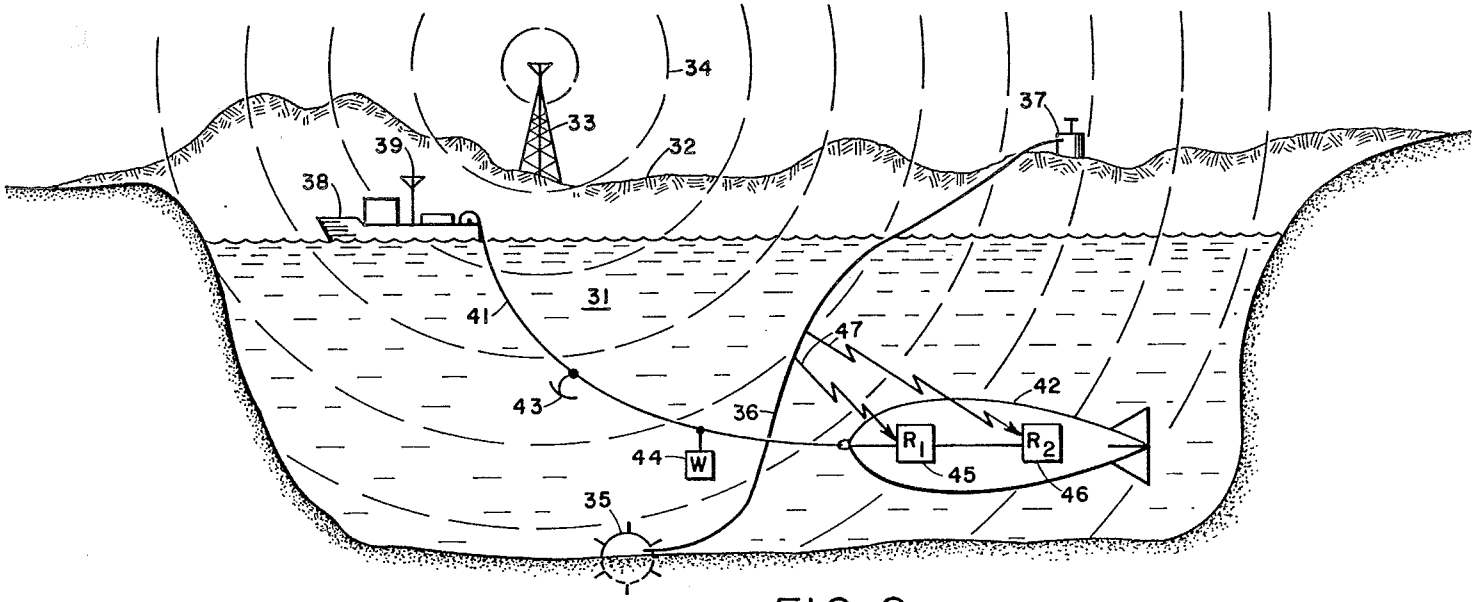
FIG. 2 is a quasi-pictorial view which illustrates an exemplary modus operandi of the system of FIG. 1.

FIG. 2 very simply portrays a representative operational situation wherein the invention may be used to an advantage. It is presented so that the discussion of the operation thereof—to be presented subsequently—may be made succinctly but with clarity.

Referring now to FIG. 2, there is shown a body of water 31, which, as previously indicated, may be a river, lake, estuary, bay, ocean, or the like. If it is a river or lake, it will most likely be fresh or brackish water, and, of course, if it is an ocean, it will be salt water. In any event, with the proper design and adjustments of the respective components of the system of FIG. 1, the invention will work in any kind of water and, as a matter of fact, in most fluids, either liquid or gaseous.

Contiguously disposed with water 31 is land 32 which may be a river bank, beach, or the like, depending on the aforesaid water situation.

At some place on said land 32 is a radio station 33—similar to transmitter 12 of FIG. 1—which broadcasts radio frequency electromagnetic energy 34 throughout its ambient environment for a distance that is proportional to its transmission power. Radio station 33, for this particular purpose, is preferably a commercial radio station which broadcasts the usual commercial and entertainment programs, thereby permitting its signal 34 to be used by the subject invention in a covert, passive manner, as will be explained more fully below. On the other hand, radio station 33 may be an especially constructed one which would then constitute one of the links in the overall system of the invention. It would, in such case, broadcast radio frequency signals 34 in the same manner as any other conventional radio transmitter, but the timing, power, frequency, and intelligence thereof would ordinarily be designed for optimizing operations during any given operational circumstances. Obviously, it would be well within the purview of the artisan to so do, if he had the benefit of the teachings presented herewith.

Located in water 31 is a marine mine 35 of the type that has one or more electrical conductors 36 (in all probability, an insulated cable containing copper wires) connected between it and an electrical energy supply 37, such as a conventional firing box, or the like. As may be seen, because mine 35 is disposed within water 31 and because firing box 37 is located somewhere on land, electrical conductors 36 are partially submerged within said water and partially extend out thereof and on land 32. Of course, the aforementioned mine 35 and firing box 37 may each be any other desired utilization apparatus interconnected by wires 36. As a matter of fact, as will be seen later, wires 36 need not have anything connected thereto, as long as it extends in and out of water 31, and the invention will function with respect thereto.

In this particular portrayal, a ship 38 is employed as the aforementioned master vehicle, and, accordingly, it preferably— but not necessarily— contains all of the components that master vehicle 21 of FIG. 1 contained. In addition, it may include a radio transmitter 39 which may be used to supply the radio frequency energy to the ambient environment in lieu of transmitting radio station 33, in the event radio station 33 would be located at a place too remote from wires 36 to supply power thereto. Of course, it, too, would make timely broadcasts at whatever frequency and power is required to energize wires 36 and still be as covert as possible, as far as an enemy or any third party is concerned.

By means of a tow cable 41 containing electrical telemetering wires or conductors, a submarine vehicle 42 is pulled through water 31. As such, it is comparable to the slave vehicle generally disclosed in FIG. 1. Of course, vehicle 42 may be any appropiate vehicle that may be guided by any suitable guidance system (not shown). Therefore, it may be a bottom follower or any other type, as desired; and if, in addition, cable control is desired as well, a diverter 43 and/or weight 44 may optionally be connected to tow cable 41 for such purpose.

In the embodiment disclosed herewith, $R_1$ radio receiving means 45 and $R_2$ radio receiving means 46 are housed within submarine vehicle 42 in such manner that radio frequency energy ambient thereto may be received thereby. Of course, receiving means 45 and receiving means 46 are spatially disposed from each other a predetermined distance, depending on the frequency of the radio wave to be received, the speed at which vehicle 42 is traveling, etc. Thus, any received radio signal 47 from wire 36 would be received at different times, thereby resulting in a phase relationship therebetween. Little or no phase relationship would ostensively occur between the radio waves received directly by receiving means 45 and 46 from transmitter 33 because of the attenuation thereof by water 31 and the small distance between said receiving means 45 and 46 compared to the relatively large distance therefrom to said transmitter 33.

Perhaps at this time, it should be pointed out that the specific physical arrangement of all of the components of the system of FIG. 1 may be such as would optimize the operation thereof during any given circumstances and environmental conditions. For instance, on the one hand, they will obviously function as deployed in FIG. 1; on the other hand, they will also function if all of the electronics are disposed in the master vehicle and only the receiving transducers are disposed in the underwater slave vehicle. As a matter of fact, it is conceivable that the receiving transducers, if properly insulated or otherwise designed, are the only elements that need be towed through the water for wire detection purposes, in the event the radio broadcast from the radio station is powerful enough to be effective for reception thereof thereby.

MODE OF OPERATION

The operation of the invention will now be discussed briefly in conjuntion with both of the figures of the drawing. For the purpose of simplifying this discussion (but without limitation), a river will be considered as being the type of aqueous medium that is transversed or swept to detect shore-controlled electrical command wires used for detonating marine mines, a tow ship will be considered as the master vehicle, and a towed underwater vehicle will be the slave vehicle, as schematically illustrated in FIG. 2.

As radio station 33 broadcasts radio frequency signals 34 throughout its ambient environment, part of them are received by that portion of wire 36 that is located in the atmosphere, as a result of antenna action of the latter. The radio signals received thereby are thus converted into current which, in turn, travels down wire 36 and is radiated therefrom along that portion thereof that is submerged within water 31 as radio frequency electromagnetic energy signals. Hence, in effect, wire 36 becomes a secondary transmitter which re-broadcasts the radio signals originally broadcast by radio station 33.

Obviously, the same thing occurs if radio transmitter 39 of ship 38 is the means for broadcasting radio frequency electromagnetic energy similar to that indicated as energy 34. Only the position of the source would be different. Therefore, for the purpose of this explanation, radio station 33 will be used.

As ship 38 tows underwater vehicle 42 by means of tow-telemetering cable 41, receiving means 45 and 46 receive radio signal 47 that is emanating from the underwater portion of wire 36. But because receiving means 45 is closer thereto than receiving means 46, signal 47 is respectively received thereby at successive times, the difference of which is contingent upon the distance therebetween and the wavelength of the broadcast radio signal. As a result, a phase relationship therebetween occurs which, when properly calibrated, is indicative of the presence of said wire 36. Of course, receiving means 45 and 46 receive signal 47 from wire 36 more readily than signal 34 from radio station 33 due to the innate attenuation of electromagnetic energy by water and because the distance to wire 36 is considerably less than the depth of the water through which signal 34 must travel in order to directly impinge thereon. Moreover, the radio signals penetrating the water from above (not the wire) are very nearly in phase, are very weak, and cancel for the most part within the circuitry of the phase comparators. Hence, if such an array of receivers is towed into a gradient electromagnetic field produced by a wire (or other electrical conductor), the wire is detected. The extent of said gradient field—and, hence, the efficiency of reception—is dependent upon a number of factors, namely: conductivity and temperature of the water, operating frequency of the transmitted radio signal, radio frequency field strength at the portion of the wire not submersed within the water, and characteristics of the land-wire installation, such as, length of the wire, the type of soil, the height of the wire above the soil, etc.

As previously indicated, transducer 16 and tuned radio receiver 17 (which is tuned for response to the frequency of the transmitting radio station only) constitutes the aforesaid $R_1$ receiving means 45, and transducer 18 and tuned radio receiver 19 (which is likewise tuned for response to the frequency of the transmitting radio station only) constitutes the aforesaid $R_2$ receiving means 46. Thus, in actual practice, signal 47, received via wire 36—as well as any received radio field directly from broadcast station 33—is received by receiving transducers 16 and 18, with the output signals thereof data processed by receivers 17 and 19, respectively, so as to amplify as necessary to be useful, filter as necessary to delete spurious signals therefrom, and otherwise refine in such manner as to make them acceptacle to optional constant output amplifiers 22 and 23.

As phase related outputs from tuned receivers 17 and 19, said signals constitute the outputs from phase gradiometer 15. They are conducted up cable 41 and supplied to the inputs of amplifiers 22 and 23, respectively.

At this time, it may be noteworthy that cable 41 is employed in the embodiment being discussed herewith as the telemetering device between the master and slave vehicles; however, it should also be understood that any other suitable telemetering link may be substituted therefor. For example, a radio or sonar telemetering link may be substituted therefor.

The aforementioned constant output amplifiers 22 and 23 are preferably incorporated in the invention to cause clean, clear, similar amplitude signals to be compared for phase difference by phase comparator 24 and, if preferred, by oscilloscope 27, thereby effecting greater accuracy of phase determination, and thereby, in turn, effecting vastly improved probabilities of detecting and indicating a submarine wire, especially one that may be submerged in fresh water and/or buried in the river bottom. Nevertheless, although preferable, the subject invention will operate without them, although at lesser efficiency. Accordingly, whether or not said constant output amplifiers are included or not would be dependent upon the complexity of the operational environment in which the invention is working.

Because the sky wave—that is, wave 34—is similarly attenuated in phase and amplitude as it penetrates the water and because it is substantially in phase at both receiving means, it is effectively canceled in the phase comparator, thereby deleting it from the system for all practical purposes.

The output of phase comparator 24 is a signal which usually contains a pair of successive amplitude spikes, with the distance (or time, if plotted on a time basis) therebetween indicating the relative phase therebetween. Thus, if said spikes are not both present in a properly phase related manner, the probabilities are that no marine mine command wire has been detected.

It has been found that wires may be detected in salt water (such as sea water) by only using a single receiving means; however, it is very often deficient in fresh water, due to the lesser electromagnetic energy attenuation characteristics of fresh water. As a result, as indicated in the following table—which suymmarized some data concerning water —at medium frequencies, the penetration of radio waves is considerable (e.g., a skin depth at 1 MHz is about 3.6 meters) in fresh water.

| | Wavelength, Meters | | Skin Depth, Meters | |
|---|---|---|---|---|
| Frequency MHz | Salt | Fresh | Salt | Fresh |
| 1 | 1.38 | 22.6 | 0.22 | 3.6 |
| 4 | 0.69 | 11.3 | 0.11 | 1.8 |
| 8 | 0.49 | 8.0 | 0.57 | 1.27 |
| 14 | 0.38 | 6.0 | 0.06 | 0.95 |

One skin depth is herewith defined as that water depth which attenuates the signal to 1/e of its former value or about 8.7 db. It is, thus, apparent from the above table that salt water will attenuate an electromagnetic signal from above sharply enough to effectively obliterate it, even at such medium frequencies as 1 MHz, in a few feet of salt water and in very shallow depths at the high frequencies —e.g., at 14 MHz. This factor, of course, causes a severe noise limitation on wire detection because the sky signal received by a single underwater receiver in fresh, shallow waters is nearly the same as that received from a wire. But, if two or more receivers are used such that they measure the phase gradient or difference of the electromagnetic field near a wire, the aforesaid noise producing conditions are obviated to the extent that the signal-to-noise ratio is vastly improved, especially in fresh water, but in salt water, too. Thus, it may readily be seen that the dual receiver means (that is, the gradiometer type receiving means), when used as the wire sensor or probe, increases the odds of detection of wires (and possibly other electrically conductive objects) to the extent that the additional expense for construction thereof is certainly warranted, especially if it is to be used for locating the control wires of marine mines in otherwise non-defendable situations, such as in rivers essentially under the fire control of an enemy.

Incidentally, although probably already apparent to the artisan, some adjustment in parameters must be made in the subject system if it is to be used in its most efficient manner. For instance, as previously suggested, the physical distance between the aforesaid receiving means 45 and 46 must be short enough that each thereof "sees" (or acquires) or receives a signal on both sides of the wire, as well as astride the wire. Otherwise, it is possible that the attenuation by the water may be so great that the furthermost receiving means could never "see" the wire within a reasonable phase-relatable time period. On the other hand, a receiver spacing compromise may be necessary to provide optimum operation for the wavelength, power, etc., of the signal broadcast from the radio transmitter, especially if a commercial one is being used for covert reasons.

Again, when the above mentioned adjustments in parameters are made for such purpose, within certain limitations, the subject invention may be designed and used for locating wires laying on or buried within land, earth materials, or any other solid mediums, as well as within or on liquid or other fluid mediums.

From the foregoing, it may readily be seen that the disclosed invention produces wire detection results heretofore unobtainable from any of the devices of the prior art, and, thus, it constitutes an improvement thereover.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A system for detecting an electrical conductor that is partially submerged within water and partially extends out thereof, comprising in combination:

means for broadcasting electromagnetic energy of predetermined radio frequency at such location that it will impinge upon that portion of the aforesaid electrical conductor that extends out of said water, thereby generating an electrical current in said electrical conductor which is re-radiated as electromagnetic energy within said water by the portion thereof that is submerged therein;

first means spatially disposed from the aforesaid electromagnetic energy broadcasting means and within said water for directly receiving that portion of said originally broadcast electromagnetic energy not attenuated by said water as it radiates therethrough and for timely receiving said re-radiated electromagnetic energy from that portion of said electrical conductor that is submerged within said water;

second means spatially disposed from the aforesaid electromagnetic energy broadcasting means and said first means for directly receiving that portion of said originally broadcast electromagnetic energy not attenuated by said water as it radiates therethrough and for receiving said re-radiated electromagnetic energy from that portion of said electrical conductor that is submerged within said water at a time that is different from the time of the receiving thereof by said first means; and means effectively connected to the outputs of said first and second receiving means for determining and indicating the phase relationship between the receptions of said re-radiated electromagnetic energy from said electrical conductor without interference from the aforesaid directly received portions of said originally broadcast electromagnetic energy radiating through said water.

2. The system of claim 1, wherein said first means spatially disposed from the aforesaid electromagnetic energy broadcasting means and within said water for directly receiving that portion of said originally broadcast electromagnetic energy not attenuated by said water as it radiates therethrough and for timely receiving re-radiated electromagnetic energy from that portion of said electrical conductor that is submerged within said water comprises:

a receiving transducer; and a radio receiver that is tuned for response to the aforesaid radio frequency of the electromagnetic energy broadcast by said broadcasting means.

3. The system of claim 1, wherein said second means spatially disposed from the aforesaid electromagnetic energy broadcasting means and said first means for directly receiving that portion of said originally broadcast electromagnetic energy not attenuated by said water as it radiates therethrough and for receiving said re-radiated electromagnetic energy from that portion of said electrical conductor that is submerged within said water at a time that is different from the time of the receiving thereof by said first means comprises:

a receiving transducer; and a radio receiver that is tuned for response to the aforesaid radio frequency of the electromagnetic energy broadcast by said broadcasting means.

4. The system of claim 1, wherein said first and second receiving means comprises a phase gradiometer.

5. The system of claim 1, wherein said means effectively connected to the outputs of said first and second receiving means for determining and indicating the phase relationship between the receptions of re-radiated electromagnetic energy from said electrical conductor without interference from the aforesaid directly received portions of said originally broadcast electromagnetic energy radiating through said water comprises:

a phase comparator; and a readout connected to the output of said phase comparator.

6. The invention of claim 5, further characterized by a pair of constant amplitude amplifiers respectively connected between the outputs of said first and second receiving means and the inputs of the aforesaid phase comparator.

7. The system of claim 1, wherein said means effectively connected to the outputs of said first and second receiving means for determining and indicating the phase relationship between the receptions of re-radiated electromagnetic energy from said electrical conductor without interference from the aforesaid directly received portions of said originally broadcast electromagnetic energy radiating through said water comprises an oscilloscope having horizontal and vertical deflection plates, with the horizontal deflection plates thereof effectively connected to the output of the aforesaid first receiving means, and with the vertical deflection plates thereof effectively connected to the output of the aforesaid second receiving means.

8. The invention of claim 7, further characterized by a pair of constant amplitude amplifiers respectively connected between the outputs of said first and second receivers and the horizontal and vertical deflection plates of the aforesaid oscilloscope.

9. The system of claim 1, wherein said means for broadcasting electromagnetic energy of predetermined radio frequency at such location that it will impinge upon that portion of the aforesaid electrical conductor that extends out of said water, thereby generating an electrical current in said electrical conductor which is re-radiated as electromagnetic energy within said water by said portion thereof that is submerged therein, comprises a radio transmitter.

10. The system of claim 9, wherein said radio transmitter is a commercial radio station.

11. The system of claim 9, wherein said radio transmitter is a mobile radio station.

12. The invention of claim 1, further characterized by means for housing said first and second receiving means in such manner that they may be moved within said water.

13. The invention of claim 12, further characterized by means connected to said housing means for the moving thereof along a predetermined course within said water.

14. The invention of claim 13, wherein said means connected to said housing means for the moving thereof along a predetermined course within said water is a ship.

15. A method of detecting an electrical conductor that is partially submerged within water and partially extends out thereof, comprising the combined steps of:

broadcasting electromagnetic energy of predetermined radio frequency at such location that it will impinge upon that portion of the aforesaid electrical conductor that extends out of said water, thereby effecting the generation of an electrical current in said electrical conductor which is re-radiated as electromagnetic energy within said water by that portion thereof that is submerged therein;

receiving said re-radiated electromagnetic energy from that portion of said electrical conductor that is submerged within said water at a first location;

receiving said re-radiated electromagnetic energy from that portion of said electrical conductor that is submerged within said water at a location that is different from said first location; and indicating the phase relationship between the aforesaid receptions of said re-radiated electromagnetic energy from said electrical conductor.

* * * * *